US009512775B2

(12) United States Patent
Takahashi et al.

(10) Patent No.: US 9,512,775 B2
(45) Date of Patent: Dec. 6, 2016

(54) COOLING SYSTEM FOR ENGINE

(71) Applicant: Mazda Motor Corporation, Aki-gun, Hiroshima (JP)

(72) Inventors: Kotaro Takahashi, Hiroshima (JP); Nobuo Yunoki, Aki-gun (JP); Masahiro Naito, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 14/830,630

(22) Filed: Aug. 19, 2015

(65) Prior Publication Data

US 2016/0090944 A1 Mar. 31, 2016

(30) Foreign Application Priority Data

Sep. 25, 2014 (JP) ..... 2014-195505

(51) Int. Cl.

| | |
|---|---|
| ***F01N 3/02*** | (2006.01) |
| ***F01N 3/10*** | (2006.01) |
| ***F02M 25/07*** | (2006.01) |
| ***F01P 7/14*** | (2006.01) |
| ***F01P 3/20*** | (2006.01) |

(52) U.S. Cl.

CPC .. *F01P 7/14* (2013.01); *F01P 3/20* (2013.01); *F02M 25/0703* (2013.01); *F02M 25/0709* (2013.01); *F02M 25/0728* (2013.01); *F02M 25/0738* (2013.01); *F01P 2060/16* (2013.01)

(58) Field of Classification Search

CPC ..... F01P 3/20; F01P 3/14; F01P 2060/16

USPC ..... 60/287, 602, 605.2, 599

See application file for complete search history.

(56) References Cited

U.S. PATENT DOCUMENTS

2013/0276765 A1* 10/2013 Moffat ..... F02M 25/07 123/568.12
2014/0000862 A1* 1/2014 Abihana ..... F01P 7/164 165/244
2015/0273976 A1* 10/2015 Enomoto ..... B60K 6/22 165/202

FOREIGN PATENT DOCUMENTS

JP 2013224643 A 10/2013

* cited by examiner

*Primary Examiner* — Audrey K Bradley
*Assistant Examiner* — Dapinder Singh
(74) *Attorney, Agent, or Firm* — Alleman Hall McCoy Russell & Tuttle LLP

(57) ABSTRACT

A cooling system for an engine is provided. The cooling system includes an EGR device including an EGR passage for recirculating exhaust gas into an intake passage, an EGR valve for adjusting a flow rate of the recirculating exhaust gas, and an EGR cooler for cooling the recirculating exhaust gas, an EGR valve controller for controlling the EGR valve, coolant flow paths including a first flow path and a second flow path and where coolant circulates, a coolant pump for circulating coolant within the coolant flow paths, a flow rate control valve for adjusting a flow rate of the coolant through the second flow path, a temperature detector for detecting a coolant temperature within the first flow path, and a valve controller for adjusting a flow rate control valve opening based on the detected temperature.

13 Claims, 10 Drawing Sheets

COOLING SYSTEM FOR ENGINE

BACKGROUND

The present invention relates to a cooling system for an engine.

Conventionally, known cooling systems for vehicles form a plurality of coolant flow paths passing through an engine body (cylinder head or cylinder block) or auxiliary machinery (heater core, exhaust gas recirculation (EGR) device, etc.), and are provided with a flow rate control valve for controlling coolant flow rates of the respective coolant flow paths (e.g., JP2013-224643A). Such a cooling system restricts the flow of the coolant into the engine body by the flow rate control valve while the engine is being warmed up after a cold start (in a cold state) so as to stimulate a temperature increase of the engine body. When the temperature of the engine body becomes high (in a warmed-up state), the cooling system cancels the flow restriction of the coolant into the engine body so as to cool the engine body.

Further, the cooling system of JP2013-224643A effectively reduces nitrogen oxide ($NO_x$) by cooling EGR gas with an EGR cooler to reduce air to be introduced into the engine body. While the engine is being warmed up after the cold start, the flow of the coolant through the coolant flow paths which pass through the cylinder head and the EGR cooler is restricted, and when the temperature of the engine body becomes high, the coolant flow restriction is canceled.

However, in the engine to which the cooling system of JP2013-224643A is applied, since the coolant is not flowed into the EGR cooler in the cold state of the engine, if the EGR gas is introduced into the EGR cooler in the cold state of the engine, the temperature of the coolant within the EGR cooler is increased to the extent that it boils, which may damage the EGR cooler. As a solution, it can be considered that in the case where the EGR gas is introduced, the coolant is flowed into the coolant path which passes the EGR cooler; however, in this manner, the cylinder head is also cooled along with the EGR cooler, and the temperature increase of the cylinder head cannot be stimulated.

SUMMARY

The present invention is made in view of the above situations and aims to provide a cooling system for an engine, which can achieve both of stimulation of temperature increase of a cylinder head by restricting a coolant flow, and damage prevention of an EGR cooler, after a cold start of the engine.

According to an aspect of the present invention, a cooling system for an engine is provided. The cooling system for the engine includes an EGR device, an EGR valve controller, coolant flow paths, a coolant pump, a flow rate control valve, a temperature detector, and a valve controller. The EGR device includes an EGR passage for recirculating, into an intake passage, a part of exhaust gas discharged from the engine, an EGR valve for adjusting a flow rate of the exhaust gas recirculating through the EGR passage, and an EGR cooler for cooling the exhaust gas recirculating through the EGR passage. The EGR valve controller controls the EGR valve. The coolant flow paths include a first flow path and a second flow path and circulate coolant therethrough, the first flow path passing through a cylinder head of the engine, the second flow path branching from the first flow path and passing through the EGR cooler. The coolant pump circulates the coolant within the coolant flow paths. The flow rate control valve adjusts a flow rate of the coolant through the second flow path. The temperature detector detects a temperature of the coolant within the first flow path. The valve controller adjusts an opening of the flow rate control valve based on the temperature detected by the temperature detector. The valve controller fully closes the flow rate control valve in a case where the detected temperature is below a predetermined temperature threshold and the EGR valve is not opened by the EGR valve controller, the valve controller opens the flow rate control valve in one of a case where the detected temperature is below the temperature threshold and the EGR valve is opened by the EGR valve controller and a case where the detected temperature is one of the temperature threshold and a value thereabove.

According to this configuration, when the detected temperature is below the temperature threshold and the EGR valve is not opened by the EGR valve controller, in other words, when the coolant flowing through the cylinder head has a low temperature and the exhaust gas (EGR gas) is not flowed into the EGR passage, the opening of the flow rate control valve is zero. Thus, the flow rate of the coolant flowing through the cylinder head is restricted, and the warming up of the cylinder head is stimulated.

On the other hand, when the detected temperature is below the temperature threshold and the EGR valve is opened by the EGR valve controller, in other words, when the coolant flowing through the cylinder head has a low temperature and the exhaust gas is flowed into the EGR passage, since the flow rate control valve is opened, the coolant flows through the EGR cooler. Therefore, excessive temperature increase of the coolant flowing through the EGR cooler can be suppressed, and the EGR cooler can be prevented from being damaged.

As described above, in a cold state of the engine, the coolant is flowed into the EGR cooler only when the EGR gas is flowed into the EGR cooler. Thus, both of stimulation in temperature increase of the cylinder head by restricting a coolant flow, and damage prevention of the EGR cooler, after the cold start of the engine, can be achieved.

The valve controller preferably adjusts the opening of the flow rate control valve such that the flow rate of the coolant for the second flow path falls below a predetermined flow rate, while the valve controller opens the flow rate control valve in the case where the detected temperature is below the temperature threshold and the EGR valve is opened by the EGR valve controller.

According to this configuration, when the coolant flowing through the cylinder head has the low temperature and the exhaust gas is flowed into the EGR passage, since the flow rate of the coolant flowing through the EGR cooler is restricted to below the predetermined flow rate, the temperature of the coolant after flowing through the EGR cooler becomes comparatively high. Therefore, even if the coolant after flowing through the EGR cooler flows into the cylinder head, the temperature increase of the cylinder head will not be interrupted.

The first flow path preferably bypasses the EGR cooler.

According to this configuration, since the first flow path bypasses the EGR cooler, the length of the first flow path can accordingly be shortened. Thus, a naturally released heat amount of the coolant through a wall face of the first flow path can be reduced, and the temperature increase of the cylinder head can be stimulated.

The first flow path preferably has a downstream flow path at a position downstream of the branching point between the first and second flow paths. The flow rate control valve preferably also adjusts the flow rate of the coolant through the downstream flow path by constantly maintaining the opening of the flow rate control valve with respect to the downstream flow path at a predetermined small opening around zero.

According to this configuration, since the opening of the flow rate control valve with respect to the downstream flow path in the first flow path is constantly maintained at the predetermined small opening around zero, a small amount of coolant is constantly flowed through the downstream flow path. Therefore, by disposing auxiliary machinery which requires constant cooling by the coolant (e.g., high-pressure EGR valve) at the downstream flow path, overheating of the auxiliary machinery can be prevented.

The cooling system preferably further includes a turbocharger including a turbine that is driven by energy of the exhaust gas passing through the exhaust passage, and a compressor that is driven by the turbine and for pressuring air within the intake passage. The EGR passage preferably communicates a position of the exhaust passage downstream of the turbine with a position of the intake passage upstream of the compressor. The EGR valve controller preferably controls the EGR valve such that the exhaust gas does not recirculate in a case where the detected temperature is below the temperature threshold and an operating state of the engine is within a low engine load range, and the EGR valve controller preferably controls the EGR valve such that the exhaust gas recirculates in a case where the detected temperature is below the temperature threshold and the operating state of the engine is within a high engine load range According to this configuration, if a load on the engine is low when the temperature of the coolant flowing through the cylinder head is low, the exhaust gas is not recirculated by the EGR device (low-pressure EGR device). Therefore, the coolant does not flow into the second flow path, the flow rate of the coolant flowing through the cylinder head is restricted, and overcooling of the cylinder head is suppressed. Further, if the load on the engine is high when the temperature of the coolant flowing through the cylinder head is low, the exhaust gas is recirculated by the EGR device. Therefore, the coolant flows into the second flow path, and the flow rate of the coolant flowing through the cylinder head is increased.

Thus, except for a case where the engine enters into the high load state due to, for example, a sharp acceleration immediately after the cold start of the engine, the exhaust gas is not recirculated by the low-pressure EGR device while warming up the engine after the cold start. Therefore, the flow rate of the coolant flowing through the cylinder head is restricted, and both of the temperature increase of the cylinder head and damage prevention of the EGR cooler can be achieved.

The flow rate control valve is preferably a rotary valve for increasing the flow rate of the coolant by increasing an opening thereof.

According to this configuration, since the rotary valve with which the coolant flow rate becomes higher as the opening thereof is increased is applied, the flow rate can easily be controlled.

DETAILED DESCRIPTION OF EMBODIMENT

Hereinafter, one preferred embodiment of the present invention is described in detail with reference to the appended drawings.

First, an engine 9 and an intake-and-exhaust system thereof according to this embodiment are described.

The engine 9 is a diesel engine for driving a vehicle.

Figure 1:
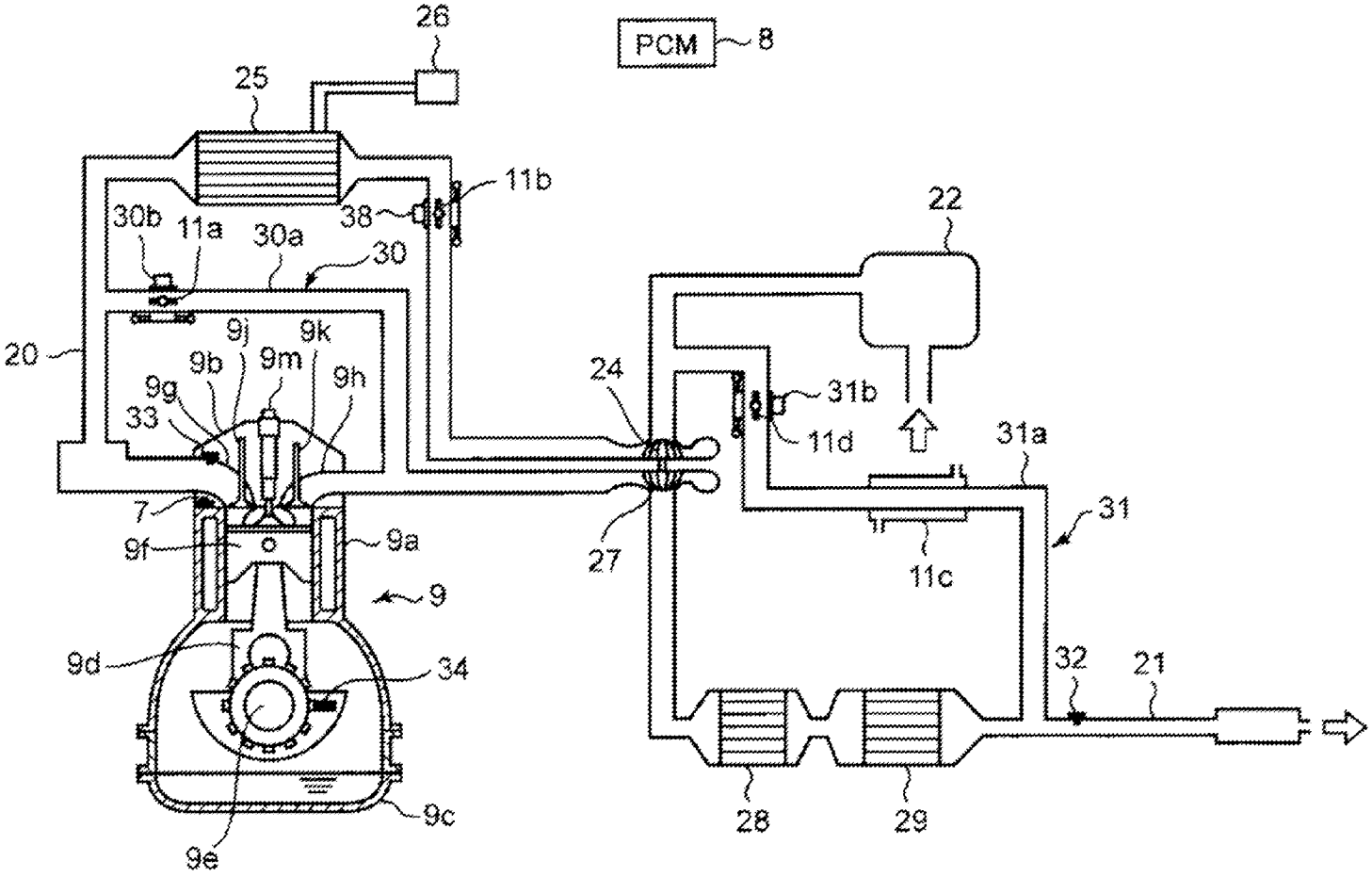
FIG. 1 is a view illustrating an engine and an intake-and-exhaust system according to an embodiment of the present invention.

The engine 9 includes a cylinder block 9*a* formed with a plurality of cylinders (only one cylinder is illustrated in FIG. 1), a cylinder head 9*b* disposed on the cylinder block 9*a*, and an oil pan 9*c* disposed below the cylinder block 9*a*.

A piston 9*f* coupled to a crankshaft 9*e* via a connecting rod 9*d* is reciprocatably fitted into each of the cylinders.

In the cylinder head 9*b*, an intake port 9*g* and an exhaust port 9*h* are formed for each of the cylinders. An intake valve 9*j* and an exhaust valve 9*k* are disposed at the intake and exhaust ports 9*g* and 9*h*, respectively.

Further, the cylinder head 9*b* is provided with electromagnetic-type direct injectors 9*m* for injecting fuel into the respective cylinders. The fuel is supplied to the direct injectors 9*m* from a fuel tank via a fuel pump and a common rail (none of them illustrated). The common rail is provided with a fuel pressure sensor 36 (see FIG. 2) for detecting a pressure of the fuel.

The intake-and-exhaust system of the engine 9 includes an intake passage 20 for introducing intake air into the cylinders via the intake ports 9*g*, and an exhaust passage 21 for discharging outdoors exhaust gas produced within the cylinders.

The intake passage 20 is provided, in the following order from the upstream side, with an air cleaner 22 for removing dust contained within the intake air, a compressor 24 of a turbocharger, an intake shutter valve 11*b* for shutting down the intake passage 20, an intake shutter valve actuator 38 for driving the intake shutter valve 11*b*, an intercooler 25 for forcibly cooling the intake air at high pressure and temperature due to being compressed by the compressor 24, and an intercooler coolant pump 26 for sending coolant to the intercooler 25.

The exhaust passage 21 is provided, in the following order from the upstream side, with an exhaust turbine 27 of the turbocharger, a diesel oxidation catalyst (DOC) 28, a diesel particulate filter (DPF) 29 for capturing exhaust particulate matter within the exhaust gas, etc.

Further, the intake-and-exhaust system includes a high-pressure exhaust gas recirculation (EGR) device 30 and a low-pressure EGR device 31.

The high-pressure EGR device 30 includes a high-pressure EGR passage 30*a* connecting a position of the intake passage 20 upstream of the intake ports 9*g* with a position of the exhaust passage 21 downstream of the exhaust ports 9*h*, a high-pressure EGR valve 11*a* for adjusting a flow rate of high-pressure EGR gas through the high-pressure EGR passage 30*a*, and a high-pressure EGR valve actuator 30*b* for driving the high-pressure EGR valve 11*a*.

The low-pressure EGR device 31 includes a low-pressure EGR passage 31*a* connecting a position of the exhaust passage 21 downstream of the DPF 29 with a position of the intake passage 20 upstream of the compressor 24, a low-pressure EGR valve 11*d* for adjusting a flow rate of low-pressure EGR gas through the low-pressure EGR passage 31*a*, a low-pressure EGR valve actuator 31*b* for driving the low-pressure EGR valve 11*d*, and a low-pressure EGR cooler 11*c* for cooling the low-pressure EGR gas.

The engine 9 and the intake-and-exhaust system configured as above are controlled by a powertrain control module (PCM) 8. The PCM 8 is comprised of a CPU, at least one memory, an interface, etc.

Figure 2:
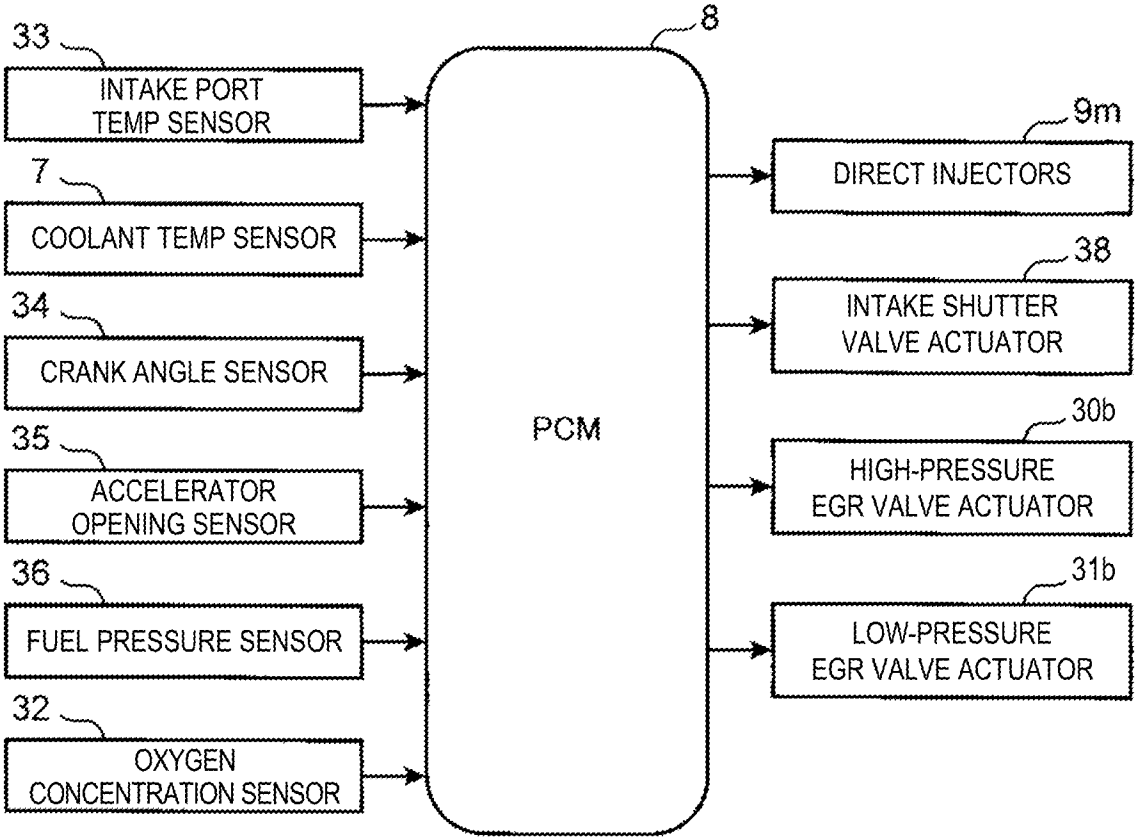
FIG. 2 is a view illustrating a PCM, an input unit, and an output unit according to the embodiment of the present invention.

As illustrated in FIG. 2, the PCM 8 receives detection signals of various sensors. The various sensors include intake port temperature sensors 33 attached to the intake ports 9*g* and for detecting temperatures of the intake air immediately before flowing into the respective cylinders (intake mixture containing intake air and exhaust gas), a coolant temperature sensor 7 for detecting a temperature of the coolant near the intake ports 9*g*, a crank angle sensor 34 for detecting a rotational angle of the crankshaft 9*e*, an accelerator opening sensor 35 for detecting an accelerator opening corresponding to an operation amount of an acceleration pedal (not illustrated) of the vehicle, the fuel pressure sensor 36 for detecting the fuel pressure to be supplied to the direct injectors 9*m*, and an oxygen concentration sensor 32 for detecting an oxygen concentration within the exhaust gas at a position downstream of the DPF 29.

The PCM 8 determines states of the engine 9, the intake-and-exhaust system and the like by performing a variety of operations based on the detection signals of the sensors, and outputs control signals to the direct injectors 9*m* and the actuators of the various valves (intake shutter valve actuator 38, high-pressure EGR valve actuator 30*b*, low-pressure EGR valve actuator 31*b*) according to the determination result.

Figure 3:
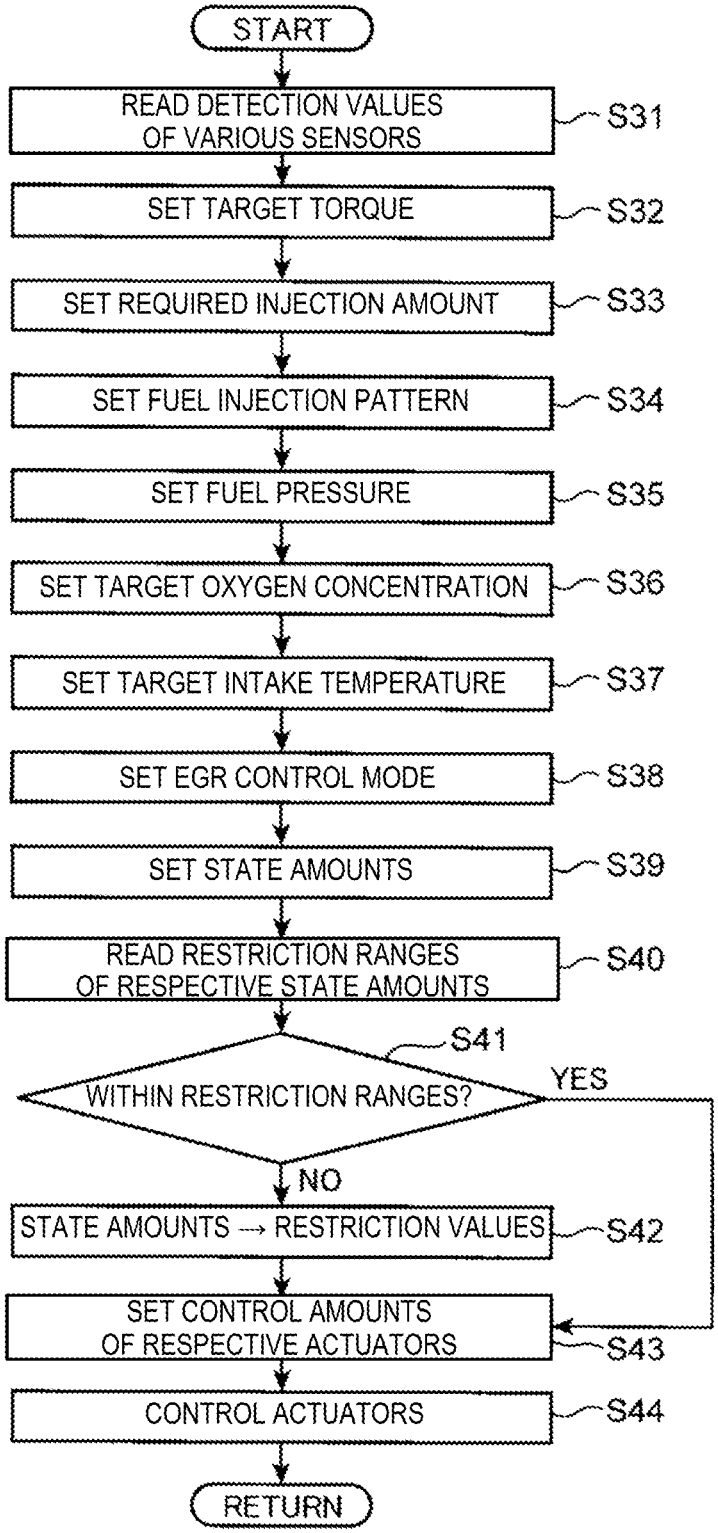
FIG. 3 is a flowchart illustrating a control of the intake-and-exhaust system of the engine according to the embodiment of the present invention.

Next, a control performed by the PCM 8 is described with reference to the flowchart of FIG. 3.

First, the PCM 8 reads the detection values of the various sensors (S31).

Subsequently, the PCM 8 calculates an engine speed based on the rotational angle detected by the crank angle sensor 34, and sets a target torque based on the engine speed and the accelerator opening detected by the accelerator opening sensor 35 (S32).

Next, the PCM 8 sets a required injection amount of fuel based on the engine speed and the target torque (S33).

Then, the PCM 8 selects a fuel injection pattern according to the required injection amount and the engine speed, from a plurality of fuel injection patterns stored in the memory beforehand (S34).

Subsequently, the PCM 8 sets a fuel pressure to be supplied to the direct injectors 9*m*, based on the required injection amount and the engine speed (S35).

Next, the PCM 8 sets a target oxygen concentration based on the required injection amount and the engine speed (S36). The target oxygen concentration is a target value of an oxygen concentration of the intake mixture immediately before flowing into the cylinders.

Then, the PCM 8 sets a target intake temperature based on the required injection amount and the engine speed (S37). The target intake temperature is a target value of a temperature of the intake mixture immediately before flowing into the cylinders.

Subsequently, the PCM 8 selects an EGR control mode according to the required injection amount and the engine speed, from a plurality of EGR control modes stored in the memory beforehand (S38). The EGR control mode is respectively selected for the high-pressure and low-pressure EGR devices 30 and 31.

Next, the PCM 8 sets state amounts (high-pressure EGR amount, low-pressure EGR amount, and turbocharging pressure) for achieving the target oxygen concentration and the target intake temperature (S39).

Then, the PCM 8 reads restriction ranges of the respective state amounts from the memory (S40). The restriction ranges are ranges which the state amounts need to meet (remain within), respectively, so that the engine 9 and the intake-and-exhaust system can suitably operate, and the restriction ranges are stored in the memory beforehand.

Subsequently, the PCM 8 determines whether the state amounts set at S39 are within the restriction ranges, respectively (S41).

If the state amounts are determined to be within the restriction ranges, respectively (S41: YES), the control proceeds to S43, where the PCM 8 sets control amounts of the direct injectors 9*m*, the intake shutter valve actuator 38, the high-pressure EGR valve actuator 30*b*, and the low-pressure EGR valve actuator 31*b* based on the state amounts set at S39, respectively.

Next, the PCM 8 controls the direct injectors 9*m*, the intake shutter valve actuator 38, the high-pressure EGR valve actuator 30*b*, and the low-pressure EGR valve actuator 31*b* based on the set control amounts, respectively (S44).

At S41, if any of the state amounts is determined to be out of the corresponding restriction range, the PCM 8 corrects the state amount to the corresponding restriction range (S42). For example, the PCM 8 corrects the state amount to a restriction value closest to the state amount set at S39 within the restriction range. After S42, the PCM 8 controls the direct injectors 9*m*, the intake shutter valve actuator 38, the high-pressure EGR valve actuator 30*b*, and the low-pressure EGR valve actuator 31*b* based on the corrected state amount (S44).

Hereinafter, the cooling system of the engine 9 according to this embodiment of the present invention is described.

Figure 4:
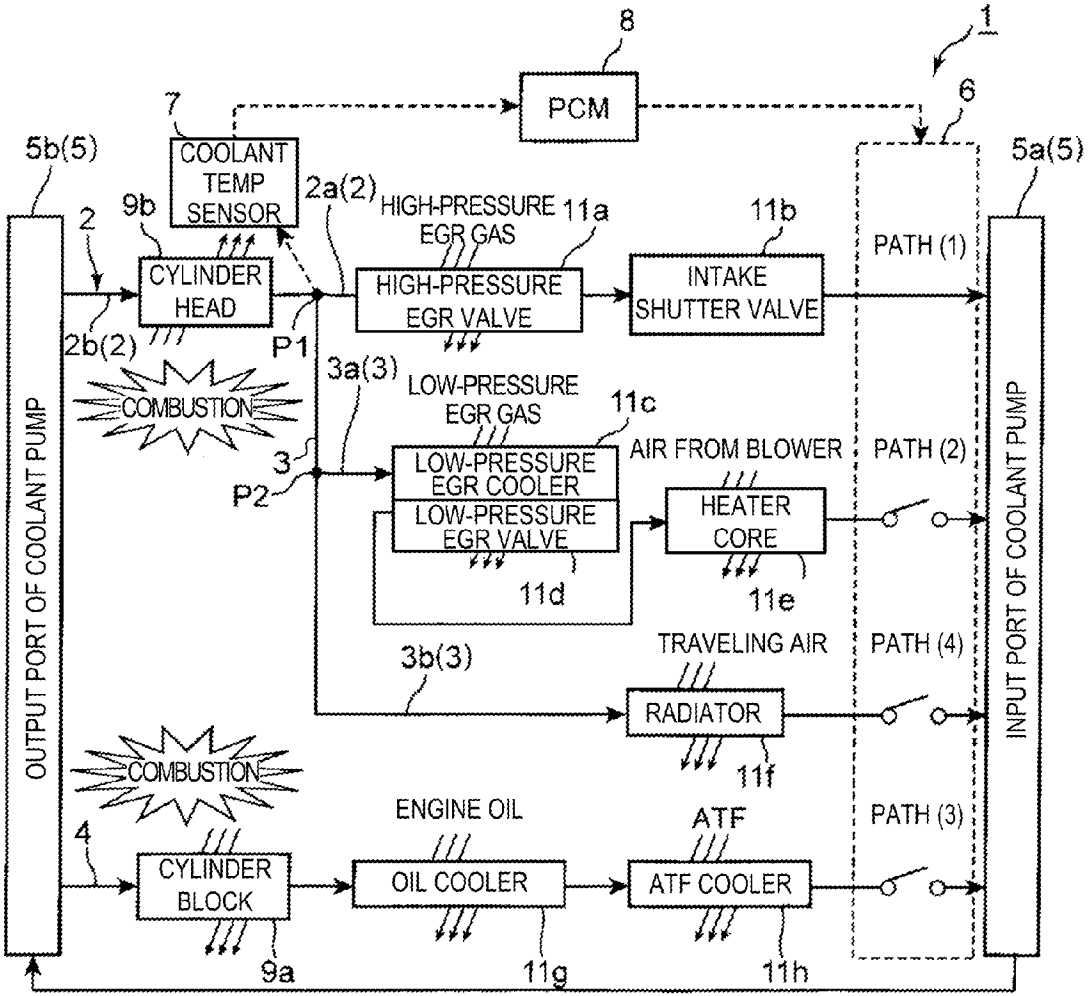
FIG. 4 is a view illustrating a cooling system of the engine according to the embodiment of the present invention.

As illustrated in FIG. 4, the cooling system 1 of the engine 9 includes coolant flow paths having a first flow path 2, a second flow path 3, and a third flow path 4, a coolant pump 5, a flow rate control valve 6, the coolant temperature sensor 7, the low-pressure EGR device 31, the high-pressure EGR device 30, and the PCM 8. The coolant circulates within the coolant flow paths.

The first flow path 2 passes through the cylinder head 9*b* of the engine 9. The first flow path 2 has a branch point P1 toward the second flow path 3 at a position downstream of the cylinder head 9*b*. The first flow path 2 has a first auxiliary flow path 2*a* (path (1)) at a position downstream of the branch point P1. The first auxiliary flow path 2*a* passes through the high-pressure EGR valve 11*a* and the intake shutter valve 11*b*.

The second flow path 3 passes through auxiliary machinery such as components 11*a*-11*f* of the engine 9. The second flow path 3 has a branch point P2 at a position downstream of the branch point P1. The second flow path 3 has a second auxiliary flow path 3*a* (path (2)) and a third auxiliary flow path 3*b* (path (4)), both connected with the branch point P2. The second and third auxiliary flow paths 3*a* and 3*b* are connected in parallel with each other at the branch point P2.

The second auxiliary flow path 3*a* passes through the low-pressure EGR valve 11*d*, the low-pressure EGR cooler 11*c*, and a heater core 11*e*.

The third auxiliary flow path 3*b* passes through a radiator 11*f*.

The third flow path 4 (path (3)) passes through the cylinder block 9*a* of the engine 9, an oil cooler 11*g*, and an automatic transmission fluid (ATF) cooler 11*h*.

The coolant pump 5 is a turbopump and structured such that an impeller thereof is indirectly coupled to the crankshaft 9*e* of the engine 9. An input port 5*a* of the coolant pump 5 is connected with a downstream end of the first auxiliary flow path 2*a*, a downstream end of the second auxiliary flow path 3*a*, a downstream end of the third auxiliary flow path 3*b*, and a downstream end of the third flow path 4, via the flow rate control valve 6. An output port 5*b* of the coolant pump 5 is connected with an upstream end of the first flow path 2 and an upstream end of the third flow path 4.

The coolant pump 5 sucks, via the input port 5*a*, the coolant within the first to third auxiliary flow paths 2*a*, 3*a*, and 3*b* and the third flow path 4 by pumping in accordance with the rotation of the impeller using a part of engine torque, and discharges the coolant to the first and third flow paths 2 and 4, via the output port 5*b*. The coolant sucked into the coolant pump 5 is mixed inside the coolant pump 5 before being discharged.

The flow rate control valve 6 is a single rotary valve. The flow rate control valve 6 has a cylindrical casing, a cylindrical valve body rotatably contained inside the casing, and an actuator for rotating the valve body in a single direction. The actuator rotates the valve body based on the control signals (drive voltage) inputted from the PCM 8. Four input ports and four output ports are formed in a side face of the casing. The four input ports are connected with the downstream ends of the first to third auxiliary flow paths 2*a*, 3*a*, and 3*b* and the third coolant flow path 4, respectively. The four output ports are connected with the input port 5*a* of the coolant pump 5.

Notched portions are formed in the side face of the valve body. Communication areas S formed between the notched portions and the output ports of the casing are individually set for the first to third auxiliary flow paths 2*a*, 3*a*, and 3*b* and the third flow path 4. In the following description, the communication area S for the first auxiliary flow path 2*a* is referred to as "the communication area S2*a*," the communication area S for the second auxiliary flow path 3*a* is referred to as "the communication area S3*a*," the communication area S for the third auxiliary flow path 3*b* is referred to as "the communication area S3*b*," and the communication area S for the third flow path 4 is referred to as "the communication area S4."

The communication area S2*a* is stable at a small area near zero regardless of a rotational angle of the valve body (see FIG. 5), which can control the flow rate of the coolant to as small as around zero so that the cylinder head 9*b* is not overcooled, while also securing a flow rate required for cooling the high-pressure EGR valve 11*a* and the intake shutter valve 11*b*.

Figure 5:
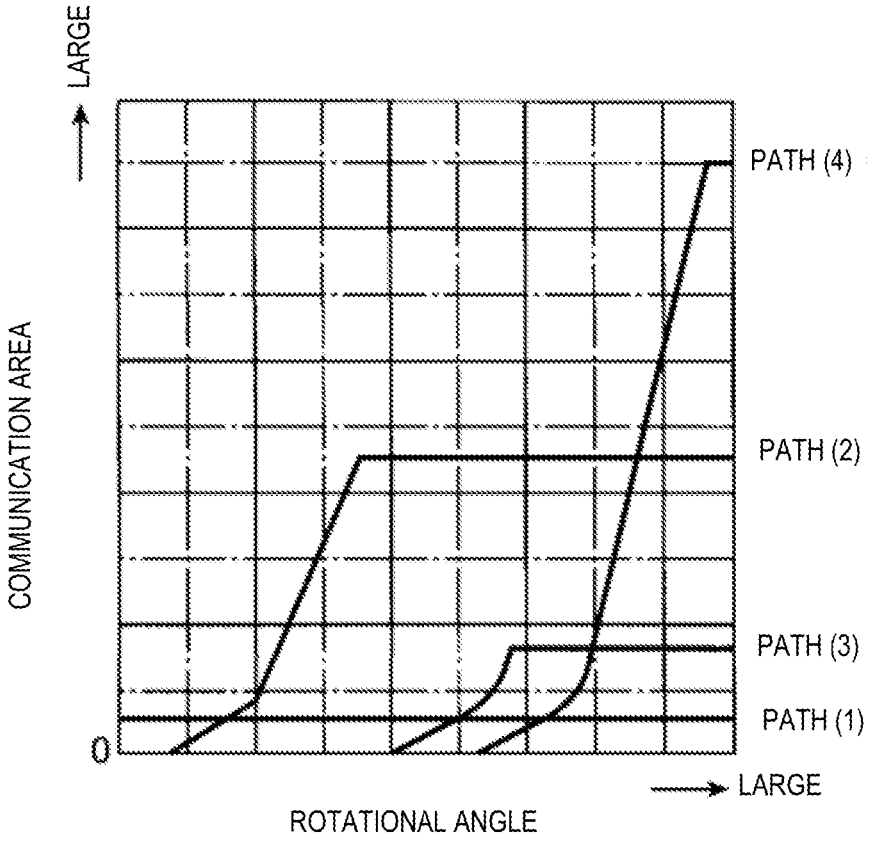
FIG. 5 is a chart illustrating relationship of a rotational angle with openings (communication areas) of a flow rate control valve according to the embodiment of the present invention.

On the other hand, the communication areas S3*a*, S3*b*, and S4 vary according to the rotational angle of the valve body (see FIG. 5).

In other words, the flow rate of the coolant through the second auxiliary flow path 3*a* is changed according to the variation of the communication area S3*a* (hereinafter, referred to as "the opening of the flow rate control valve 6 with respect to the second auxiliary flow path 3*a*").

Further, the flow rate of the coolant through the third auxiliary flow path 3*b* is changed according to the variation of the communication area S3*b* (hereinafter, referred to as "the opening of the flow rate control valve 6 with respect to the third auxiliary flow path 3*b*").

Further, the flow rate of the coolant through the third flow path 4 is changed according to the variation of the communication area S4 (hereinafter, referred to as "the opening of the flow rate control valve 6 with respect to the third flow path 4").

The coolant temperature sensor 7 detects the temperature of the coolant at a position of the first flow path 2, near the cylinder head 9*b*. The information of the temperature detected by the coolant temperature sensor 7 is transmitted to the PCM 8.

The PCM 8 has a valve control function to control the openings of the flow rate control valve 6 based on the temperature detected by the coolant temperature sensor 7.

Figure 6:
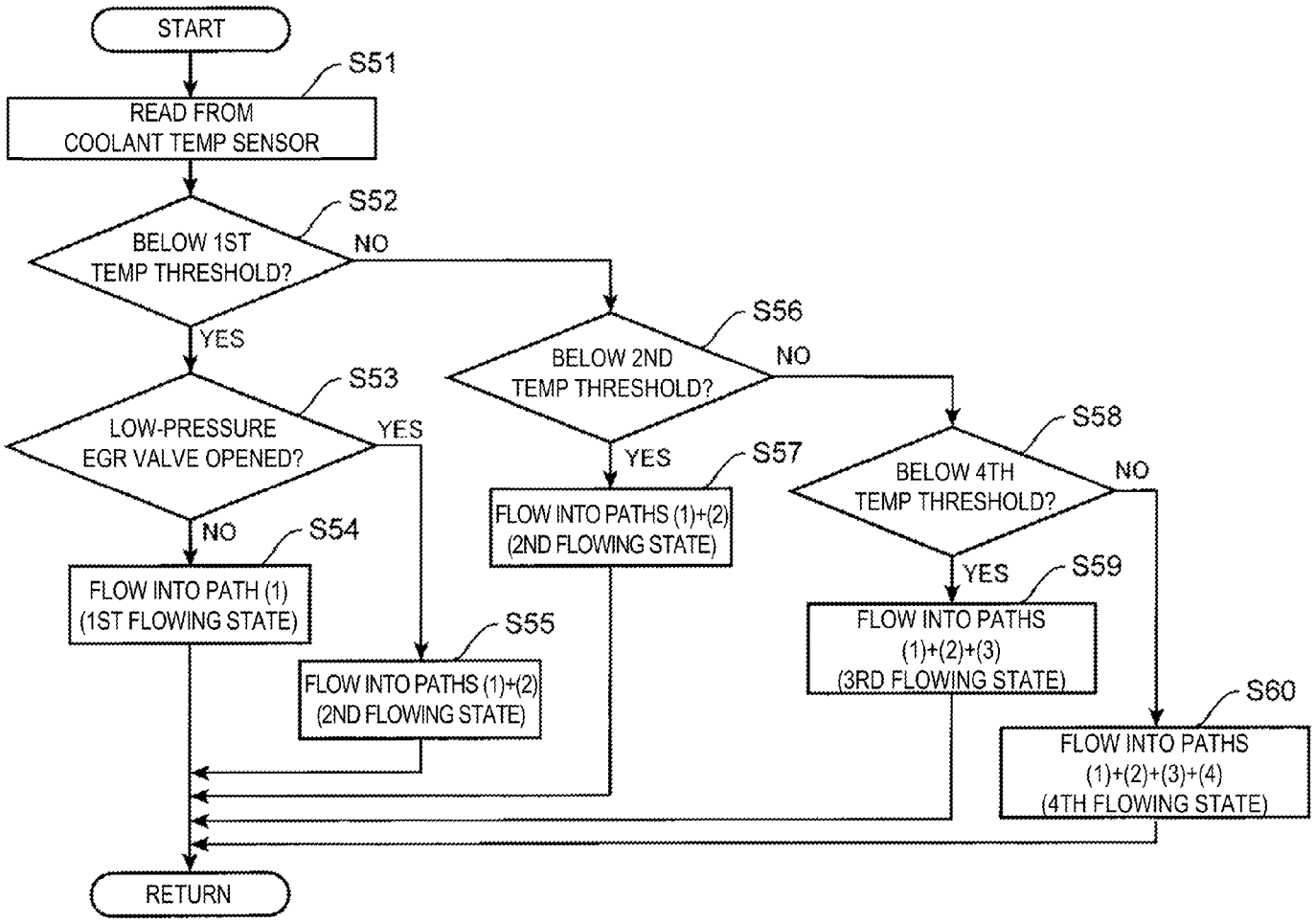
FIG. 6 is a flowchart illustrating a coolant flow switching operation among coolant flow paths according to the embodiment of the present invention.

Hereinafter, a control of the cooling system by the PCM 8 is described with reference to the flowchart of FIG. 6.

Note that, in the following description, the control is started while the openings of the flow rate control valve 6 with respect to the second and third auxiliary flow paths 3*a* and 3*b* and the third flow path 4 are zero (closed).

First, the PCM 8 receives a temperature T of the coolant near the cylinder head 9*b* from the coolant temperature sensor 7 (S51).

Figure 8:
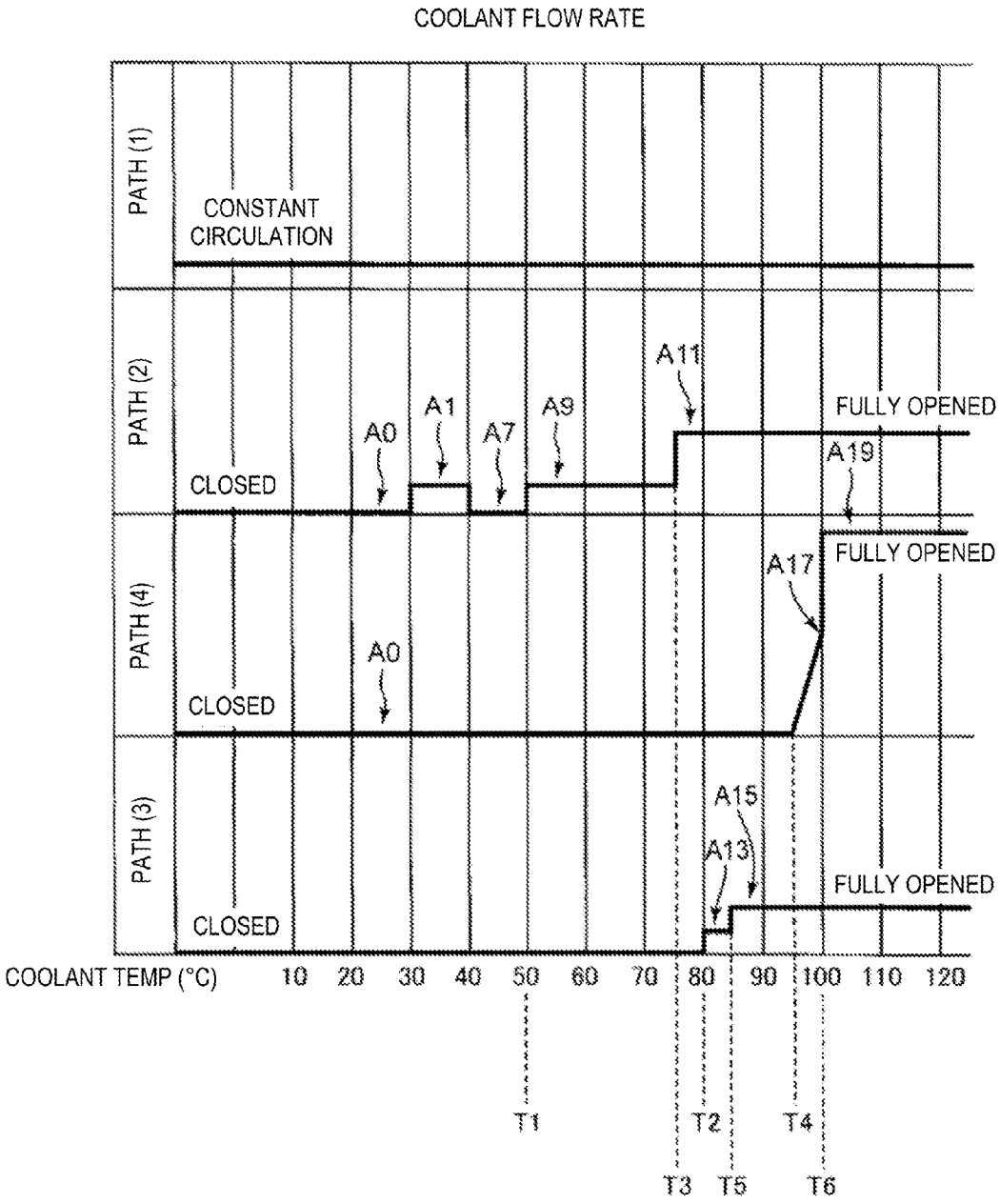
FIG. 8 shows charts illustrating timings of increasing the openings of the flow rate control valve according to the embodiment of the present invention.

Next, the PCM 8 determines whether the received temperature T is below a first temperature threshold T1 (S52). Here, the first temperature threshold T1 is below a temperature at which the engine 9 transitions from a cold state into a warmed-up state after the cold start (e.g., substantially 80° C.), in other words, a temperature while the engine warms up (before being completely warmed up), for example 50° C. (see FIG. 8).

If the temperature T is determined to be below the first temperature threshold T1 (S52: YES), at S53, the PCM 8 determines whether a control of opening the low-pressure EGR valve 11*d* (see S44 in FIG. 3) is started.

Figure 9:
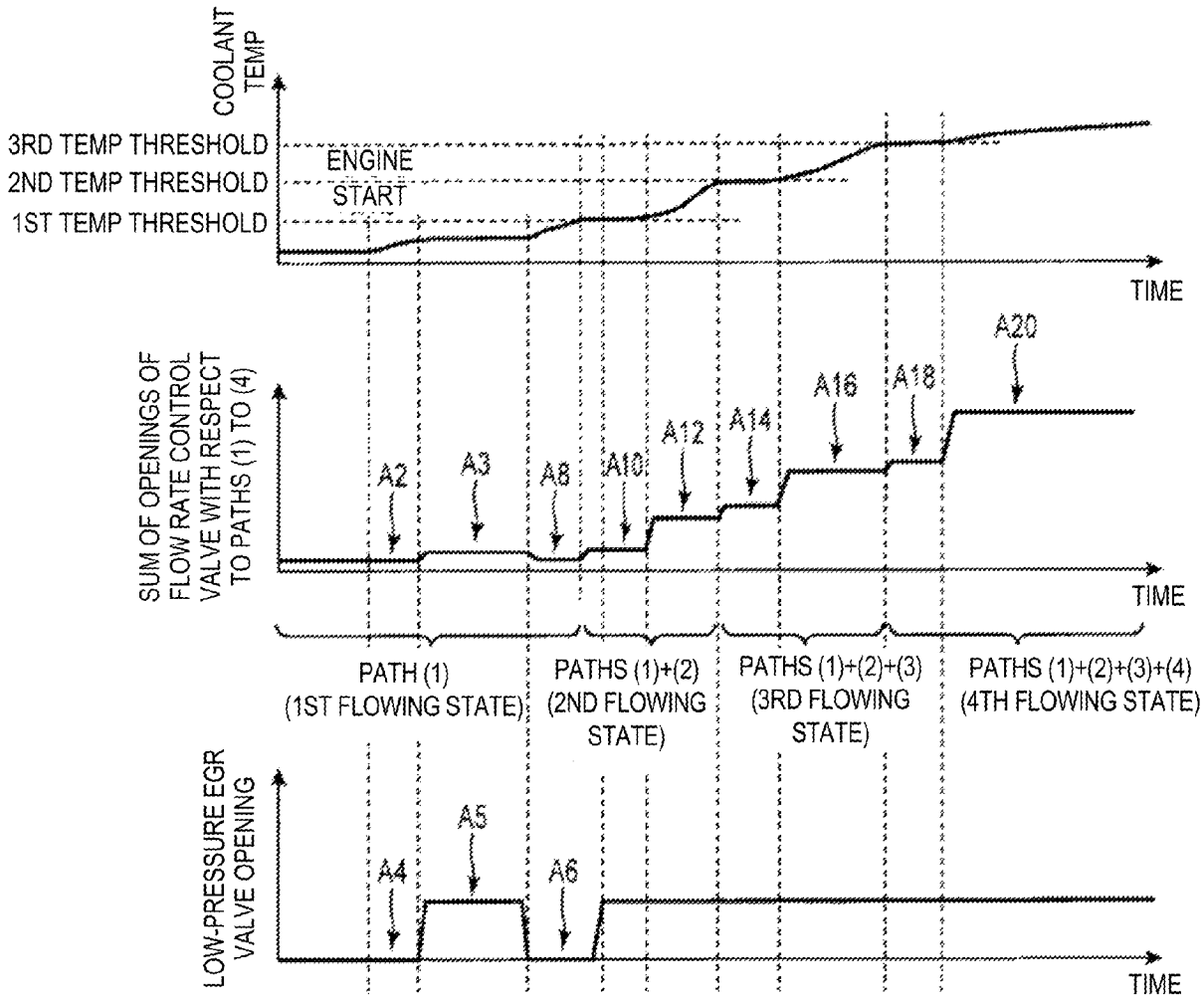
FIG. 9 shows charts illustrating a temperature change of the coolant (upper chart) and a change of sum of the openings of the flow rate control valve with respect to the respective flow paths (lower chart) according to the embodiment of the present invention.

If the control of opening the low-pressure EGR valve 11*d* is determined as not started as indicated by A4 in FIG. 9 (S53: NO), at S54, the PCM 8 maintains the openings of the flow rate control valve 6 with respect to the second and third auxiliary flow paths 3*a* and 3*b* and the third flow path 4 at zero (see A0 in FIG. 8) so as to restrict the flow rate of the coolant flowing through part of the first flow path 2 on the upstream side of the branch point P1 (hereinafter, referred to as "the upstream flow path 2*b* of the first flow path 2"), in other words, the flow rate of the coolant flowing through the cylinder head 9*b*. Thus, the flow rate of the coolant flowing through the upstream flow path 2*b* of the first flow path 2 becomes equivalent to that flowing through the first auxiliary flow path 2*a* (path (1)), and is controlled to as small as around zero (see A2 in FIG. 9). Therefore, a temperature decrease of the cylinder head 9*b* is suppressed, and the temperature of the cylinder head 9*b* eventually increases (first flowing state in FIG. 9). Note that, at S54, the PCM 8 also maintains the opening of the flow rate control valve 6 with respect to the third flow path 4 at zero. Thus, the temperature decrease of the cylinder block 9*a* is suppressed, and the temperature of the cylinder block 9*a* eventually increases. Then, the control returns to S51.

The control of opening the low-pressure EGR valve 11*d* is determined as started as indicated by A5 in FIG. 9 (S53: YES), the PCM 8 increases the opening of (opens) the flow rate control valve 6 with respect to the second auxiliary flow path 3*a* (see A1 in FIG. 8, A3 in FIG. 9) to cancel the flow rate restriction of the coolant in the first flow path 2 (S55).

At S55, the PCM 8 adjusts the opening of the flow rate control valve 6 with respect to the second auxiliary flow path 3*a* to reach a predetermined opening which is below a first target opening (e.g., about ⅓ of the first target opening). Note that the "first target opening" used here is a target opening for the warmed-up state, and means a largest opening (fully opened state) of the flow rate control valve 6 with respect to the second auxiliary flow path 3*a*.

Thus, a small amount of coolant starts to flow into the second auxiliary flow path 3*a*, and the coolant flowed through the second auxiliary flow path 3*a* flows into the first flow path 2 via the coolant pump 5. In other words, the flow rate of the coolant flowing through the upstream flow path 2*b* of the first flow path 2 is the sum of the flow rate of the coolant flowing through the first auxiliary flow path 2*a* (path (1)) and the flow rate of the coolant flowing through the second auxiliary flow path 3*a* (path (2)), which means the flow rate increases compared to that at S54. However, since the opening of the flow rate control valve 6 with respect to the second auxiliary flow path 3*a* is not immediately fully opened, but opened to, for example, about ⅓ of the fully opened state, the flow rate restriction of the coolant at the first flow path 2 is started to be gradually canceled, and the overcooling of the cylinder head 9*b* can be prevented.

Further, by flowing the coolant through the second auxiliary flow path 3*a*, an excessive temperature increase of the coolant at the low-pressure EGR cooler 11*c* is suppressed and the low-pressure EGR cooler 11*c* can be prevented from being damaged.

After S55, the control returns to S51. In a case where the control proceeds to S54 after returning back to S51 (in a case where the low-pressure EGR valve 11*d* is closed as indicated by A6 in FIG. 9), the opening of the flow rate control valve 6 with respect to the second auxiliary flow path 3*a* is returned to zero (see A7 in FIG. 8, A8 in FIG. 9).

If the temperature T is determined to be the first temperature threshold T1 or higher (S52: NO), at S56, the PCM 8 determines whether the temperature T is below a second temperature threshold T2 (e.g., 80° C., see FIG. 8). Note that the second temperature threshold T2 is above the first temperature threshold T1.

If the temperature T is determined to be below the second temperature threshold T2 (S56: YES), the PCM 8 increases the opening of (opens) the flow rate control valve 6 with respect to the second auxiliary flow path 3*a* to cancel the flow rate restriction of the coolant in the first flow path 2 (S57). Then, the control returns to S51.

Figure 7:
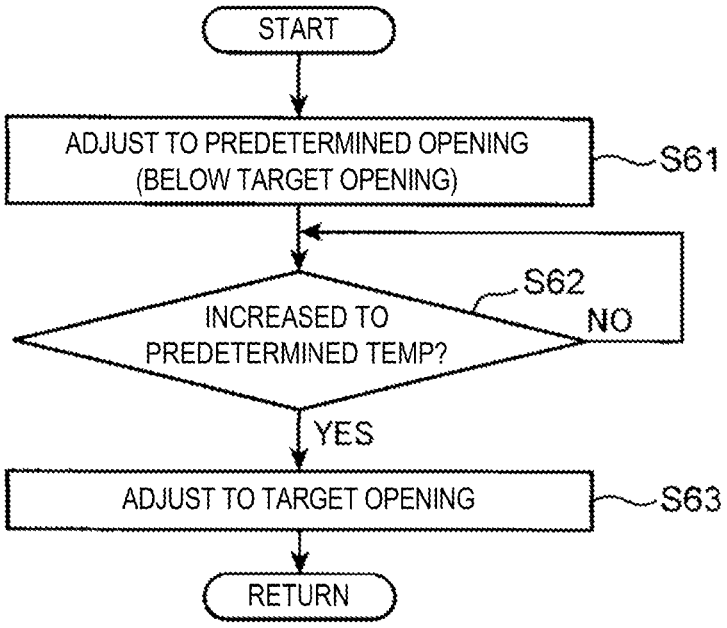
FIG. 7 is a flowchart illustrating an open control of the flow rate control valve in a stepwise fashion according to the embodiment of the present invention.

Here, the control performed at S57 is described in detail with reference to the flowchart of FIG. 7. First at S61, the PCM 8 adjusts the opening of the flow rate control valve 6 with respect to the second auxiliary flow path 3*a* to reach the predetermined opening which is below the first target opening (e.g., about ⅓ of the first target opening, see A9 in FIG. 8).

Thus, a small amount of coolant starts to flow into the second auxiliary flow path 3*a*, and the coolant flowed through the second auxiliary flow path 3*a* flows into the first flow path 2 via the coolant pump 5. In other words, the flow rate of the coolant flowing through the upstream flow path 2*b* of the first flow path 2 is the sum of the flow rate of the coolant flowing through the first auxiliary flow path 2*a* (path (1)) and the flow rate of the coolant flowing through the second auxiliary flow path 3*a* (path (2)), which means the flow rate increases compared to that at S54 (see A10 in FIG. 9). However, since the opening of the flow rate control valve 6 with respect to the second auxiliary flow path 3*a* is not immediately fully opened, but opened to, for example, about ⅓ of the fully opened state, the cancelation of the flow rate restriction of the coolant at the first flow path 2 is performed gradually.

Then, the PCM 8 determines whether the temperature T detected by the coolant temperature sensor 7 is the same or above a third temperature threshold T3 (e.g., 75° C., see FIG. 8) which is above the first temperature threshold T1 but below the second temperature threshold T2 (S62).

If the temperature T is determined to be the same or above the third temperature threshold T3 (S62: YES), at S63, the PCM 8 adjusts the opening of the flow rate control valve 6 with respect to the second auxiliary flow path 3*a* to reach the first target opening for the warmed-up state (see A11 in FIG. 8). Thus, the flow rate of the coolant flowing through the second auxiliary flow path 3*a* (path (2)) is increased to a target flow rate for the warmed-up state (a largest flow rate for the second auxiliary flow path 3*a*), and accordingly the flow rate of the coolant flowing through the upstream flow path 2*b* of the first flow path 2 is also increased (see A12 in FIG. 9). Since the flow rate is gradually increased in two steps of S61 and S63, the cancelation of the flow rate restriction in the first flow path 2 is gradually performed (second flowing state in FIG. 9).

Returning to FIG. 6, if the temperature T is determined to be the second temperature threshold T2 or higher (S56: NO), at S58, the PCM 8 determines whether the temperature T is below a fourth temperature threshold T4 (e.g., 95° C., see FIG. 8). Note that the fourth temperature threshold T4 is above the third temperature threshold T3.

If the temperature T is determined to be below the fourth temperature threshold T4 (S58: YES), the PCM 8 increases the opening of (opens) the flow rate control valve 6 with respect to the third flow path 4 (S59). Then, the control returns to S51.

Here, the control performed at S59 is described in detail with reference to the flowchart of FIG. 7. First at S61, the PCM 8 adjusts the opening of the flow rate control valve 6 with respect to the third flow path 4 to reach a predetermined opening which is below a second target opening (e.g., about ½ of the second target opening, see A13 in FIG. 8, A14 in FIG. 9). Thus, a small amount of coolant starts to flow into the third flow path 4, and the coolant flowed through the third flow path 4 flows into the first and third flow paths 2 and 4 via the coolant pump 5. Note that the "second target opening" used here is a target opening for the warmed-up state, and means a largest opening (fully opened state) of the flow rate control valve 6 with respect to the third flow path 4.

Then, the PCM 8 determines whether the temperature T detected by the coolant temperature sensor 7 is the same or above a fifth temperature threshold T5 (e.g., 85° C., see FIG. 8) which is above the second temperature threshold T2 but below the fourth temperature threshold T4 (S62).

If the temperature T is determined to be the same or above the fifth temperature threshold T5 (S62: YES), at S63, the PCM 8 adjusts the opening of the flow rate control valve 6 with respect to the third flow path 4 to reach the second target opening (see A15 in FIG. 8, A16 in FIG. 9). Thus, the flow rate of the coolant flowing through the third flow path 4 (path (3)) is increased to a target flow rate for the warmed-up state (a largest flow rate for the third flow path 4). In other words, the flow rate of the coolant flowing out from the third flow path 4 is gradually increased in two steps of S61 and S63 (third flowing state in FIG. 9).

Returning to FIG. 6, if the temperature T is determined to be the fourth temperature threshold T4 or higher (S58: NO), the PCM 8 increases the opening of (opens) the flow rate control valve 6 with respect to the third auxiliary flow path 3*b* (S60). Then, the control returns to S51.

Here, the control performed at S60 is described in detail with reference to the flowchart of FIG. 7. First at S61, the PCM 8 adjusts the opening of the flow rate control valve 6 with respect to the third auxiliary flow path 3*b* to reach a predetermined opening which is below a third target opening (e.g., about ½ of the third target opening, see A11 in FIG. 8). Note that the "third target opening" used here is a target opening for the warmed-up state, and means a largest opening (fully opened state) of the flow rate control valve 6 with respect to the third auxiliary flow path 3*b*.

Thus, the flow rate of the coolant flowing through the upstream flow path 2*b* of the first flow path 2 increases compared to that at S57 (see A18 in FIG. 9). However, since the opening of the flow rate control valve 6 with respect to the third auxiliary flow path 3*b* is not immediately fully opened, but opened to, for example, about ½ of the fully opened state, the cancelation of the flow rate restriction of the coolant through the first flow path 2 is performed gradually.

Then, the PCM 8 determines whether the temperature T detected by the coolant temperature sensor 7 is the same or above a sixth temperature threshold T6 (e.g., 100° C., see FIG. 8) which is above the fourth temperature threshold T4 (S62).

If the temperature T is determined to be the same or above the sixth temperature threshold T6 (S62: YES), at S63, the PCM 8 adjusts the opening of the flow rate control valve 6 with respect to the third auxiliary flow path 3*b* to reach the third target opening for the warmed-up state (see A19 in FIG. 8). Thus, the flow rate of the coolant flowing through the third auxiliary flow path 3*b* (path (4)) is increased to a target flow rate for the warmed-up state (a largest flow rate for the third auxiliary flow path 3*b*), and accordingly the flow rate of the coolant flowing through the upstream flow path 2*b* of the first flow path 2 is also increased (see A20 in FIG. 9). In other words, since the flow rate is gradually increased in two steps of S61 and S63, the cancelation of the flow rate restriction in the first flow path 2 is gradually performed (fourth flowing state in FIG. 9).

As described above, according to this embodiment, when the temperature detected by the coolant temperature sensor 7 is below the first temperature threshold T1 and the control of opening the low-pressure EGR valve 11*d* is not started by the PCM 8, in other words, when the coolant flowing through the cylinder head 9*b* has a low temperature and the exhaust gas is not flowed into the EGR passage 31*a*, the openings of the flow rate control valve 6 with respect to the second and third auxiliary flow paths 3*a* and 3*b* are zero, and therefore, the flow rate of the coolant flowing through the cylinder head 9*b* is restricted and the temperature increase of the cylinder head 9*b* is stimulated.

On the other hand, when the temperature detected by the coolant temperature sensor 7 is below the first temperature threshold T1 and the control of opening the low-pressure EGR valve 11*d* is started by the PCM 8, in other words, when the coolant flowing through the cylinder head 9*b* has a low temperature and the exhaust gas is flowed into the EGR passage 31*a*, the opening of the flow rate control valve 6 with respect to the second auxiliary flow path 3*a* is increased (the flow rate control valve 6 is opened), and therefore, the coolant flows through the low-pressure EGR cooler 11*c*. Thus, the excessive temperature increase of the coolant flowing through the low-pressure EGR cooler 11*c* can be suppressed, and the low-pressure EGR cooler 11*c* can be prevented from being damaged.

Therefore, both of stimulation in temperature increase of the cylinder head 9*b* by restricting the coolant flow, and damage prevention of the low-pressure EGR cooler 11*c*, after the cold start of the engine 9 can be achieved.

When the temperature of the coolant flowing through the cylinder head 9*b* is the first temperature threshold T1 or higher, since the openings of the flow rate control valve 6 with respect to the second and third auxiliary flow paths 3*a* and 3*b* are increased to the predetermined target openings in the stepwise fashion, respectively, the flow rate restriction of the coolant flowing through the cylinder head 9*b* is gradually canceled and the temperature decrease (overcooling) of the cylinder head 9*b* can be suppressed.

When the temperature of the coolant flowing through the cylinder head 9*b* is low and the exhaust gas is flowed into the EGR passage 31*a*, since the flow rate of the coolant flowing through the low-pressure EGR cooler 11*c* is restricted to, for example, ⅓ of the largest flow rate, the temperature of the coolant after flowing through the low-pressure EGR cooler 11*c* becomes comparatively high. Therefore, even if the coolant after flowing through the low-pressure EGR cooler 11*c* flows into the cylinder head 9*b*, the temperature increase of the cylinder head 9*b* will not be interrupted.

Since the first flow path 2 does not pass through the low-pressure EGR cooler 11*c*, the length of the first flow path 2 can accordingly be shortened. Thus, the amount of heat of the coolant naturally released through a wall face of the first flow path 2*a* can be reduced, and the temperature increase of the cylinder head 9*b* can be stimulated.

Since the opening of the flow rate control valve 6 with respect to the first auxiliary flow path 2*a* is constantly maintained at a predetermined small opening around zero, a small amount of coolant constantly flows into the first auxiliary flow path 2*a*. Therefore, by disposing the auxiliary machinery which requires constant cooling by the coolant (e.g., the high-pressure EGR valve 11*a*) at the first auxiliary flow path 2*a*, the overheating of the auxiliary machinery can be prevented.

If a load on the engine 9 is low (the operating state of the engine 9 is within a low engine load range) when the temperature of the coolant flowing through the cylinder head 9*b* is low (below the first temperature threshold T1), the exhaust gas is not recirculated by the low-pressure EGR device 31, and the exhaust gas is recirculated by the high-pressure EGR device 30. Therefore, the coolant does not flow into the second auxiliary flow path 3*a*, the flow rate of the coolant flowing through the cylinder head 9*b* is restricted, and the overcooling of the cylinder head 9*b* is suppressed. Further, if the load on the engine 9 is high (the operating state of the engine 9 is within a high engine load range) when the temperature of the coolant flowing through the cylinder head 9*b* is low, the exhaust gas is recirculated by the low-pressure EGR device 31. Therefore, the coolant is flowed into the second auxiliary flow path 3*a* and the flow rate of the coolant flowing through the cylinder head 9*b* is increased.

In other words, except for a case where the engine 9 enters a high load state due to, for example, a sharp acceleration immediately after the cold start of the engine 9, the exhaust gas is not recirculated by the low-pressure EGR device 31 while warming up the engine 9 after the cold start, and therefore, the flow rate of the coolant flowing through the cylinder head 9*b* is restricted, and both of the stimulation in temperature increase of the cylinder head 9*b* and damage prevention of the low-pressure EGR cooler 11*c* can be achieved.

Since the rotary valve with which the coolant flow rate becomes higher as the opening thereof is increased is used as the flow rate control valve 6, the flow rate can easily be controlled.

Figure 10:
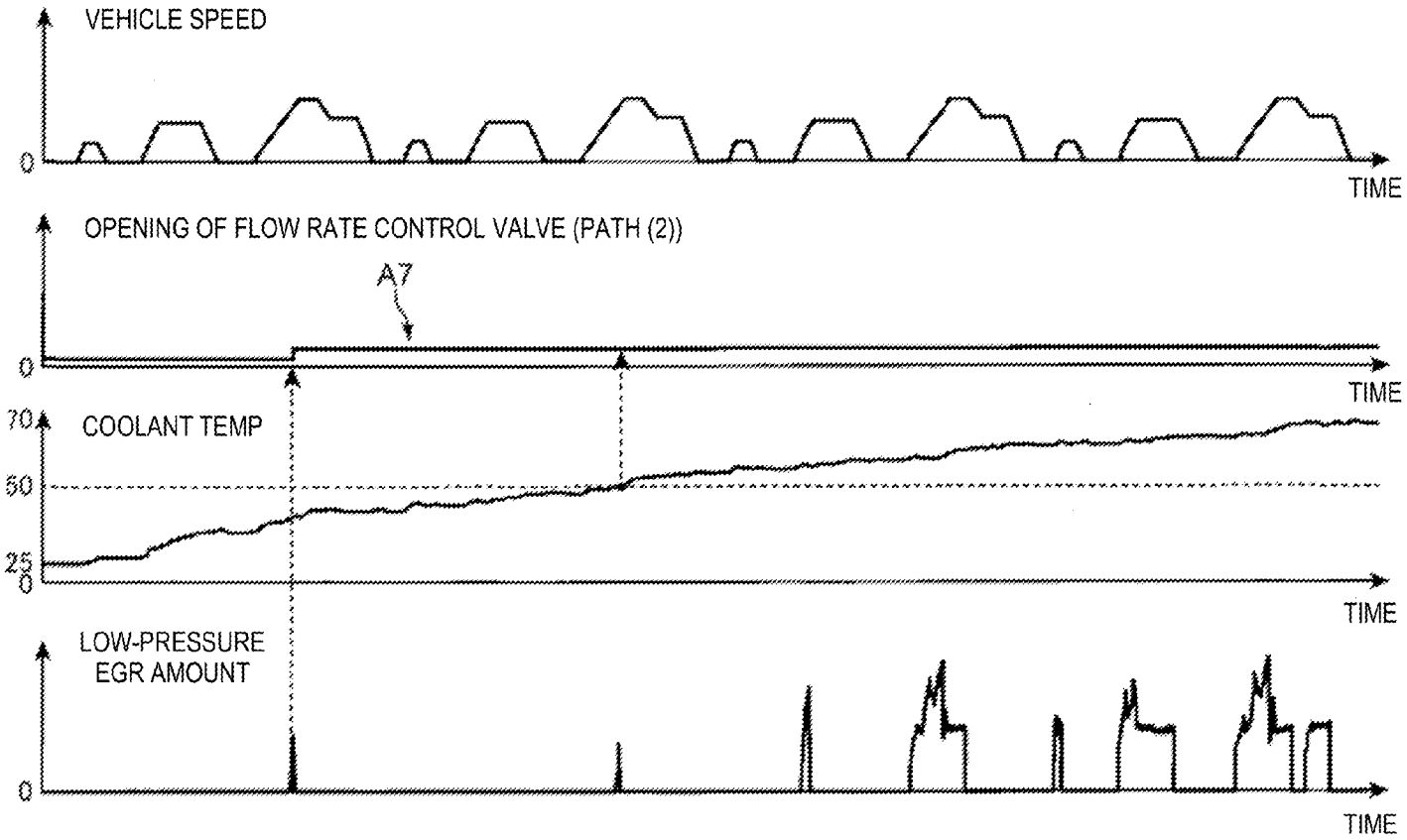
FIG. 10 shows charts illustrating relationship among a vehicle speed, the opening of the flow rate control valve, the coolant temperature, and a low-pressure EGR amount in a modification of the embodiment of the present invention.

Note that, in this embodiment, when the control of opening of the low-pressure EGR valve 11*d* is determined as started, the opening of the flow rate control valve 6 with respect to the second auxiliary flow path 3*a* is increased (the valve is opened), and when the low-pressure EGR valve 11*d* is then determined as closed, the opening of the flow rate control valve 6 with respect to the second auxiliary flow path 3*a* is adjusted back to zero (see FIGS. 8 and 9); however, it is not limited to this. For example, after the opening of the flow rate control valve 6 with respect to the second auxiliary flow path 3*a* is increased (the valve is opened), regardless of the low-pressure EGR valve 11*d* closed or not, the flow rate control valve 6 may be kept open (see A7 in FIG. 10). In this manner, repetition of opening and closing the flow rate control valve 6 in accordance with opening and closing of the low-pressure EGR valve 11*d* can be prevented.

When the state where the opening of the low-pressure EGR valve 11*d* is determined to have been a predetermined opening or larger continuously for a predetermined period of time, the opening of the flow rate control valve 6 with respect to the second auxiliary flow path 3*a* may be increased (the valve may be opened). In this manner, the opening of the flow rate control valve 6 is not increased in a case where the low-pressure EGR valve 11*d* is only opened for an extremely short period of time, and therefore, an unnecessary decrease in temperature of the cylinder head 9*b* can be suppressed.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

| | |
|---|---|
| 1 | Cooling System of Engine |
| 2 | First Flow Path |
| 2a | First Auxiliary Flow Path |
| 3 | Second Flow Path |

-continued

DESCRIPTION OF REFERENCE CHARACTERS

| | |
|---|---|
| 3a | Second Auxiliary Flow Path |
| 3b | Third Auxiliary Flow Path |
| 4 | Third Flow Path |
| 5 | Coolant Pump |
| 5a | Input Port of Coolant Pump |
| 5b | Output Port of Coolant Pump |
| 6 | Flow Rate Control Valve |
| 7 | Coolant Temperature Sensor |
| 8 | PCM |
| 9 | Engine |
| 9a | Cylinder Block |
| 9b | Cylinder Head |
| 11a-11f | Auxiliary Machinery |
| 11a | High-pressure EGR Valve |
| 11b | Intake Shutter Valve |
| 11c | Low-pressure EGR Cooler |
| 11d | Low-pressure EGR Valve |
| 11e | Heater Core |
| 11f | Radiator |
| 11g | Oil Cooler |
| 11h | ATF Cooler |
| 30 | High-pressure EGR Device |
| 31 | Low-pressure EGR Device |

What is claimed is:

1. A cooling system for an engine, comprising:

an exhaust gas recirculation (EGR) device including an EGR passage for recirculating, into an intake passage, a part of exhaust gas discharged from the engine, an EGR valve for adjusting a flow rate of the exhaust gas recirculating through the EGR passage, and an EGR cooler for cooling the exhaust gas recirculating through the EGR passage;

an EGR valve controller for controlling the EGR valve;

coolant flow paths including a first flow path and a second flow path and where coolant circulates, the first flow path passing through a cylinder head of the engine, the second flow path branching from the first flow path and passing through the EGR cooler;

a coolant pump for circulating the coolant within the coolant flow paths;

a flow rate control valve for adjusting a flow rate of the coolant through the second flow path;

a temperature detector for detecting a temperature of the coolant within the first flow path; and a valve controller for adjusting an opening of the flow rate control valve based on the temperature detected by the temperature detector, wherein the valve controller fully closes the flow rate control valve in a case where the detected temperature is below a predetermined temperature threshold and the EGR valve is not opened by the EGR valve controller, the valve controller opens the flow rate control valve in one of a case where the detected temperature is below the temperature threshold and the EGR valve is opened by the EGR valve controller and a case where the detected temperature is one of the temperature threshold and a value thereabove.

2. The cooling system of claim 1, wherein the first flow path bypasses the EGR cooler.

3. The cooling system of claim 1, further comprising a turbocharger including a turbine that is driven by energy of the exhaust gas passing through the exhaust passage, and a compressor that is driven by the turbine and for pressuring air within the intake passage, wherein the EGR passage communicates a position of the exhaust passage downstream of the turbine with a position of the intake passage upstream of the compressor, and wherein the EGR valve controller controls the EGR valve such that the exhaust gas does not recirculate in a case where the detected temperature is below the temperature threshold and an operating state of the engine is within a low engine load range, and the EGR valve controller controls the EGR valve such that the exhaust gas recirculates in a case where the detected temperature is below the temperature threshold and the operating state of the engine is within a high engine load range.

4. The cooling system of claim 1, wherein the flow rate control valve is a rotary valve for increasing the flow rate of the coolant by increasing an opening thereof.

5. The cooling system of claim 1, wherein the first flow path has a downstream flow path at a position downstream of the branching point between the first and second flow paths, and wherein the flow rate control valve also adjusts the flow rate of the coolant through the downstream flow path by constantly maintaining the opening of the flow rate control valve with respect to the downstream flow path at a predetermined small opening around zero.

6. The cooling system of claim 5, wherein the flow rate control valve is a rotary valve for increasing the flow rate of the coolant by increasing an opening thereof.

7. The cooling system of claim 1, wherein the valve controller adjusts the opening of the flow rate control valve such that the flow rate of the coolant for the second flow path falls below a predetermined flow rate, while the valve controller opens the flow rate control valve in the case where the detected temperature is below the temperature threshold and the EGR valve is opened by the EGR valve controller.

8. The cooling system of claim 7, wherein the first flow path has a downstream flow path at a position downstream of the branching point between the first and second flow paths, and wherein the flow rate control valve also adjusts the flow rate of the coolant through the downstream flow path by constantly maintaining the opening of the flow rate control valve with respect to the downstream flow path at a predetermined small opening around zero.

9. The cooling system of claim 7, further comprising a turbocharger including a turbine that is driven by energy of the exhaust gas passing through the exhaust passage, and a compressor that is driven by the turbine and for pressuring air within the intake passage, wherein the EGR passage communicates a position of the exhaust passage downstream of the turbine with a position of the intake passage upstream of the compressor, and wherein the EGR valve controller controls the EGR valve such that the exhaust gas does not recirculate in a case where the detected temperature is below the temperature threshold and an operating state of the engine is within a low engine load range, and the EGR valve controller controls the EGR valve such that the exhaust gas recirculates in a case where the detected temperature is below the temperature threshold and the operating state of the engine is within a high engine load range.

10. The cooling system of claim 7, wherein the first flow path bypasses the EGR cooler.

11. The cooling system of claim 10, further comprising a turbocharger including a turbine that is driven by energy of the exhaust gas passing through the exhaust passage, and a compressor that is driven by the turbine and for pressuring air within the intake passage, wherein the EGR passage communicates a position of the exhaust passage downstream of the turbine with a position of the intake passage upstream of the compressor, and wherein the EGR valve controller controls the EGR valve such that the exhaust gas does not recirculate in a case where the detected temperature is below the temperature threshold and an operating state of the engine is within a low engine load range, and the EGR valve controller controls the EGR valve such that the exhaust gas recirculates in a case where the detected temperature is below the temperature threshold and the operating state of the engine is within a high engine load range.

12. The cooling system of claim 10, wherein the first flow path has a downstream flow path at a position downstream of the branching point between the first and second flow paths, and wherein the flow rate control valve also adjusts the flow rate of the coolant through the downstream flow path by constantly maintaining the opening of the flow rate control valve with respect to the downstream flow path at a predetermined small opening around zero.

13. The cooling system of claim 12, further comprising a turbocharger including a turbine that is driven by energy of the exhaust gas passing through the exhaust passage, and a compressor that is driven by the turbine and for pressuring air within the intake passage, wherein the EGR passage communicates a position of the exhaust passage downstream of the turbine with a position of the intake passage upstream of the compressor, and wherein the EGR valve controller controls the EGR valve such that the exhaust gas does not recirculate in a case where the detected temperature is below the temperature threshold and an operating state of the engine is within a low engine load range, and the EGR valve controller controls the EGR valve such that the exhaust gas recirculates in a case where the detected temperature is below the temperature threshold and the operating state of the engine is within a high engine load range.

* * * * *